US005944063A

United States Patent [19]

Kurmis

[11] Patent Number: 5,944,063

[45] Date of Patent: Aug. 31, 1999

[54] CABLE-TYING TOOL

[75] Inventor: Viktor Kurmis, Pinneberg, Germany

[73] Assignee: Paul Hellermann GmbH, Pinneberg, Germany

[21] Appl. No.: 08/947,838

[22] Filed: Oct. 9, 1997

[30] Foreign Application Priority Data

Oct. 10, 1996 [DE] Germany ..... 296 17 652

[51] Int. Cl.[6] ..... B21F 9/02

[52] U.S. Cl. ..... 140/93.2; 140/93 A

[58] Field of Search ..... 140/93 A, 93.2, 140/123.6

[56] References Cited

U.S. PATENT DOCUMENTS 5,205,328 4/1993 Johnson et al. ..... 140/93.2
5,417,253 5/1995 Kurmis ..... 140/93.2

FOREIGN PATENT DOCUMENTS 2 401 742 3/1979 France ..... B25B 25/00
89 13 511 4/1991 Germany ..... B65B 27/10
91 14 901 4/1994 Germany ..... B65B 27/10

*Primary Examiner*—Lowell A. Larson
*Attorney, Agent, or Firm*—Alix, Yale & Ristas, LLP

[57] ABSTRACT

Tool for tying an article, in particular a cable harness, by means of a tape (7), which tool comprises a tool body (1), a carriage (12) that can move forwards and backwards thereon along a carriage guide (13, 14), and a closed pulling means (15, 16, 17, 18), which can be driven in only one direction, for the carriage drive, the forward and backward runs (15, 16) of the said pulling means (15, 16, 17, 18) being parallel and adjacent to the carriage guide (13, 14), and having a driver dog (19) for the carriage (12). According to the invention, in the region of each of the two runs (15, 16) there is provided a coupling stop, on the carriage, each of which is assigned to a run and cooperates with the driver dog. Expediently, the coupling stops (22, 34, 35), on the carriage (12) and assigned to the two runs, are connected by a guide track (20, 21, 23) accommodating the driver dog (19) on its deflection path (17, 18) from one run (15, 16) to the other.

6 Claims, 2 Drawing Sheets

CABLE-TYING TOOL

Figure 1:
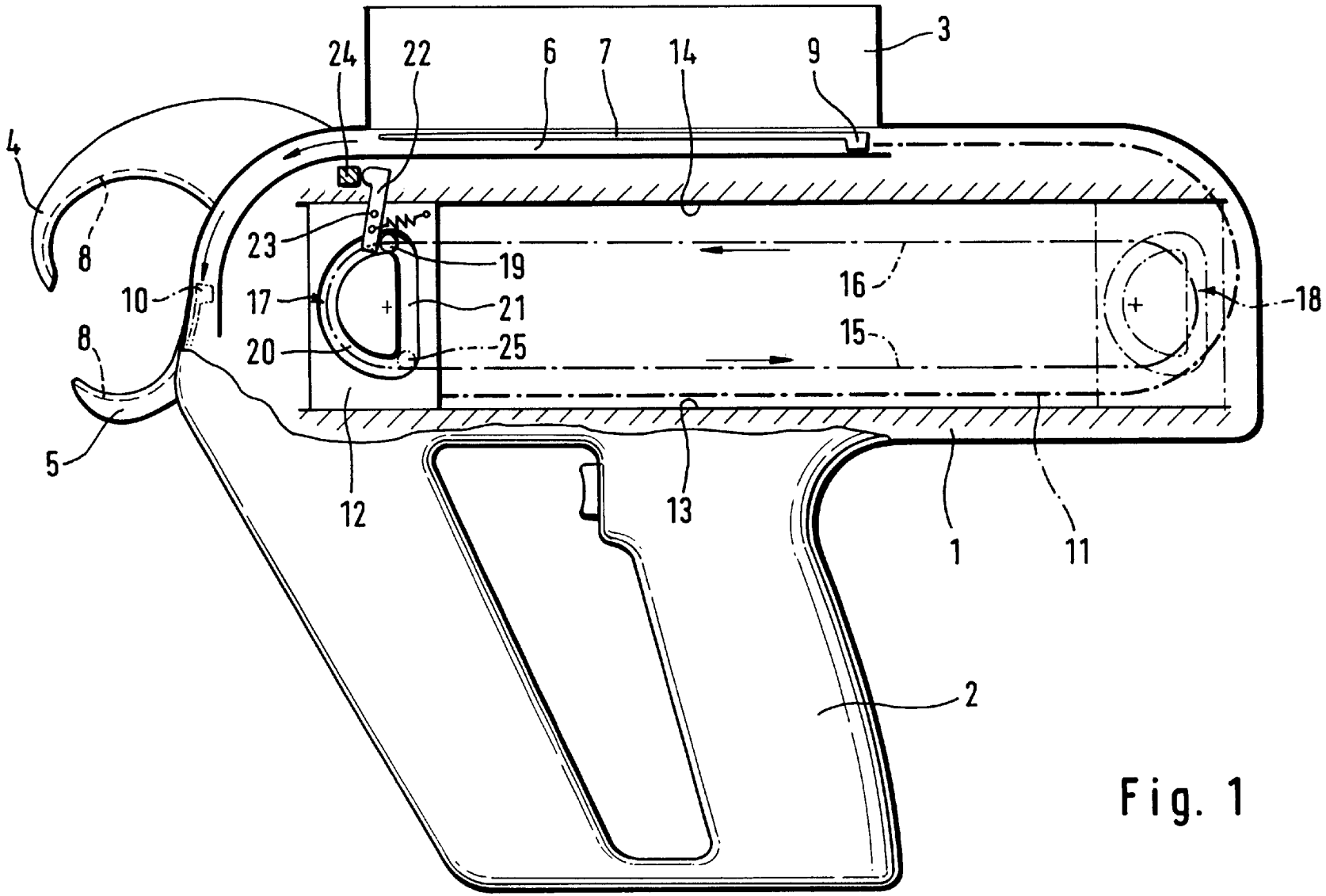

The invention relates to a tool for tying an article, in particular a cable harness, by means of a tape, which tool comprises a tool body, a carriage that can move forwards and backwards thereon along a carriage guide in order to push the tape forwards into a wrapping position about the article to be tied and/or in order to tension the tape. Provided for the carriage drive is a closed pulling means that can be driven only in one direction, whose forward and backward runs are parallel and adjacent to the carriage guide and which has a driver dog for the carriage.

Known tools of this type, which are designated cable-tying tools because of their preferred field of application, although they are also used for other purposes, for example for closing packaging bags, use so-called cable ties made of tough elastic plastic, which are composed in one piece of an elongated tape tongue and a closure at one end of the same, into whose closure opening the free end of the tape is guided back and locked following sufficient tensioning. Located at the front end of an elongated tool body are tongs which can be closed around the article to be tied and contain a guide groove through which the cable tie is pushed forward with the free end of the tape tongue forward, in order to wrap around the article. The advance travel is at least equal to the length of the cable tie and can therefore be considerable. In the case of a known cable-tying tool (FR-A 24 01 742), a carriage that is moved by means of a piston/cylinder drive is used for this. This means that the overall length of the tool body must be at least as great as the sum of the lengths of the tape and of the piston/cylinder device, that is to say more than twice the tape length. In the case of long tape lengths the tool is so long that it can hardly be handled, and its great length also constitutes a considerable disadvantage even for short tape lengths. The pneumatic drive is also relatively complicated. In the case of another known tool (DE-U-89 13 511), a flexible slider is provided, which runs over the circumference of a roll by which it is driven. This has the disadvantage that the drive direction has to be reversed in order to pull back the slider. This is avoided in the case of a further known design (U.S. Pat. No. 5,205,328), on which the formation of the precharacterizing clause of claim 1 is based. Arranged in parallel with the guide of a carriage are the two runs of a chain that circulates in only one direction. The carriage is connected to the chain via a connecting link that projects towards the centre line between the two runs, the point of its connection to the carriage having a distance from the chain which is precisely equal to the radius of the two chain deflections. When the chain circulates around the deflections, this connecting point therefore lies precisely on the axis of rotation and does not suffer any translatory movement during this circulation. It follows from this that the carriage in each case remains stationary when the driver dog is located in the region of one of the two deflections. This has the disadvantage that the theoretical standstill of the carriage is only brought about in practice if the driver dog is guided very precisely on the chain which—for example in the case of wear of the chain—is not always ensured.

The invention is based on the object of providing a drive device that is of short construction and uncomplicated for the tapes to be processed. The solution according to the invention consists in the features of claim 1, preferably also those of the subclaims.

Accordingly, for the drive of the carriage provision is made of a closed pulling means that can be driven in only one direction, for example a chain, whose forward and backward runs are parallel and adjacent to the carriage guide and on which a driver dog is provided which, at least in the region of the runs, is coupled to the carriage or can be coupled to it. The driver dog running on one run in the advance direction takes the carriage with it in this direction and hence effects the advance. When the driver dog runs back once more on the other run, it takes the carriage back with it once more into the initial position.

The latter movement can also be employed in order to use the carriage for tensioning the tape, as is known per se. For this purpose, the carriage can be provided with a clamp which grips the leading end of the tape tongue after it has passed the closure opening. A separate device ensures that the end of the tape projecting beyond the closure is cut off as soon as the required tape tension is achieved. The tensioning length, which is limiting and may vary from case to case, therefore does not impede the carriage in travelling back over the entire advance travel into its initial position.

In order to be able to take the carriage with it, there must be a device on the carriage against which the driver dog strikes and which is therefore designated a coupling stop. Two such coupling stops are provided for the two different drive directions of the driver dog running forwards and backwards. In a simple embodiment, the coupling stops are constructed as projections that project into the path of the driver dog on the one run or the other run, and whose extent is restricted to this path. As soon as the driver dog leaves this path in the deflection region at the ends of the pulling means, in order to change over to the other run, it loses contact with the coupling stop; the coupling connection is thereby released. As soon as it reaches its path on the other run, it comes into engagement with the other coupling stop, with the result that it now takes the carriage with it in the other direction. The standstill time of the carriage while the driver dog is changing from one run to the other can be used for tool operations during which no tape advance is intended to take place, for example the feeding of a new cable tie from a magazine into the cable-tie guide, or the threading of the free end of the tape into the head of the cable tape before the latter is tensioned.

It may be desirable for the driver dog not to lose the coupling connection with the carriage even in the region of the deflection from one run to the other, since it could otherwise occur that the carriage is inadvertently displaced in the uncoupled state, and the driver dog subsequently does not find the coupling stop or does not find it at the correct time. The further development of the invention therefore provides for the coupling stops on the carriage and assigned to the two runs to be connected by a guide track accommodating the driver dog on its deflection path from one run to the other. When it is not required for the carriage to stand still in the deflection region, a simple transverse groove on the carriage is sufficient for the construction of the coupling stops and the guide track connecting them, into which groove the driver dog, constructed as a pin, engages. If the carriage is intended to stand still, the limits of the guide track are selected such that they comprise the deflection path of the driver dog from one run to the other. The contour of the guide track is preferably selected to coincide with the contour of the deflection path. If the carriage is required to stand still only in part of the deflection path of the driver dog, it is sufficient to configure only an appropriate section of the guide track to coincide with the deflection path of the driver dog.

The coupling stops on the carriage may be formed by the flanks of the guide track provided on the carriage for the driver dog. However, if the guide track corresponds to the deflection path of the driver dog, and the latter runs smoothly in a curve from the advance path to the return path of the driver dog, then the guide track forms an acute angle with the advance or return direction at the stop point, which is not expedient for the transmission of the drive forces. It can therefore be provided that, at least for that drive direction in which considerable forces have to be transmitted, a special coupling stop is provided on the carriage, which in each case projects into the path of the driver dog in that region in which forces have to be transmitted, and can be switched out in each case at the end of such a path. The switching in and switching out of the coupling stop is expediently performed by a control cam provided in a stationary manner on the tool body. For example, the coupling stop may be displaceable on the carriage transversely to the advance direction, the displacement being brought about by means of a control cam provided in a stationary manner on the tool body.

Preference is given to an embodiment in which the coupling stop is urged into the coupling position by spring force and can be removed therefrom by exceeding a coupling force threshold. If the advance or return resistance exceeds the coupling force threshold, then the coupling stop is released. A first advantage of such an arrangement is that the arrangement cannot suffer any damage if, as the result of an operational fault, the carriage is inadvertently held firmly in the region of its advance or return path. A second advantage is that the switching-out movement of the coupling stop can easily be controlled, since it is sufficient to hold the carriage firmly in that position in which the advance or return movement is intended to end, by means of the stationary control cam. It is more expedient to allow the control cam to act on the coupling stop itself, since the control forces may be minimized thereby. An example of this will be found in the description of the figures.

The deflection path of the pulling means from one run to the other will often be a circular arc, specifically if the pulling means is guided over a deflection roller at the end. If the standstill time of the carriage during the path of the driver dog through this circular arc is not sufficient for the tool operations to be carried out during the advance standstill, it is possible, according to the invention, to configure the deflection path to be longer than a circular arc, by leading the pulling means over roundabout paths in the deflection region.

These further tool operations can also be derived from the pulling means, in that the latter are provided, for example, with further driver dogs or control cams, which are preferably neutral with respect to the carriage. The pulling-means drive can also be synchronized with other drive devices for the other tool operations, for example by means of a gear transmission.

Figure 2:
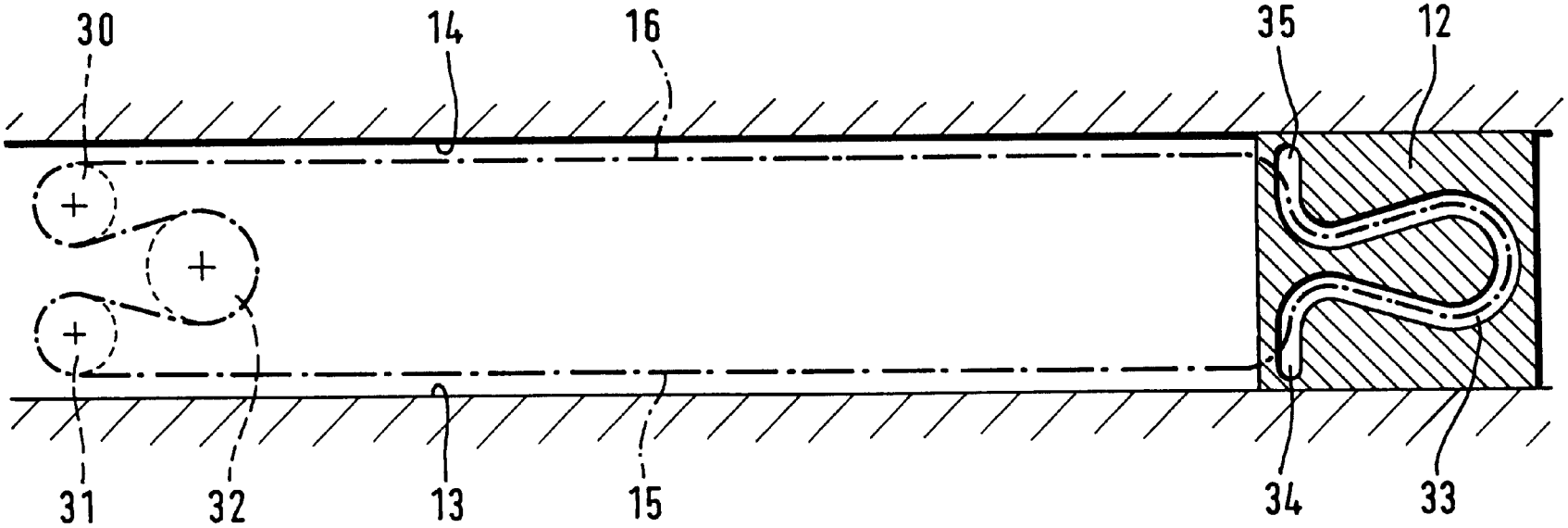

The invention is explained in more detail below with reference to the drawing, which illustrates advantageous exemplary embodiments in schematic form. In the figures:

FIG. 1 shows a side view of a cable-tying tool having an advance device constructed according to the invention and FIG. 2 shows the schematic layout of alternative chain guidance.

The tool according to FIG. 1 has an elongated tool body 1 with a pistol grip 2 and tape magazine 3, at the front end of which tongs 4, 5 are arranged which, at the beginning of the operating cycle, are closed around the article to be tied. A tape 7 located in the tape guide channel 6 in then pushed forward in the direction of the arrow. The tape guide channel 6 is adjoined by a tape guide groove 8 in the tongs 4, 5. The tape is guided therein around the article to be tied, until the closure 9 located at the rear tape end is located in the dash-dotted position 10. By means of devices that are not shown, the leading free end of the tape 7 is then guided through the closure 9. The protecting end is gripped and tensioned and finally cut off.

For the advance of the tape 7, the embodiment according to FIG. 1 uses a flexible push rod, which is indicated by a thick dash-dotted line 11. It acts with its front end on the rear end of the tape 7. Its rear end is connected to a carriage 12. It is guided over its entire length in a suitable manner, not illustrated.

The carriage 12 is located in a carriage guide, which is formed by guide surfaces 13, 14 that run parallel to each other in the longitudinal direction of the tool body 1. The carriage 12 can move in these between the front extreme position, which is illustrated with continuous lines, and a rear end position which is indicated with dash-dotted lines. If it is moved from its front position into its rear position, it pushes the push rod 11 forwards and hence effects the advancing of the tape 7.

Provided for the drive of the carriage 12 is a closed chain which forms a lower run 15 and an upper run 16. It can be driven in the direction of the arrow and makes one revolution during each operating cycle. At the ends it comprises deflections 17, 18, in that it is guided, for example, over a pair of deflection wheels (not illustrated). In this case, the deflections 17, 18 have the form of a semicircle. Firmly fitted to the chain 15–18 is a driver dog 19 which, for example, is formed by a cylindrical bolt projecting sideways. In order to accommodate this bolt, there is provided in the carriage 12 a groove which is composed of a semicircular section 20, which is congruent with the deflection curve 17, and a straight section 21 that connects the ends of the said section 20 and runs transversely with respect to the direction of the runs 15, 16. Approximately at the upper transition point from the straight section 21 into the arcuate section 20, the lower end of a two-armed lever 22 projects into the groove, the said lever being mounted on the carriage 12 such that it can pivot about a fixed pivot 23, and its upper end projecting beyond the carriage. The lever 23 is urged, by spring force in the anticlockwise direction, into that position in which its lower end projects into the groove 20, 21. It can be pivoted out of this position counter to the spring force. It forms the coupling stop mentioned further above.

At the point at which the upper end of the lever 22 is located, shortly before the carriage 12 reaches its front end position, there is a stationary stop 24 that prevents the further movement of the upper end of the lever. If the carriage movement is continued, the lever 22 is therefore forced to rotate in the clockwise direction counter to the spring action. As a result, its lower end passes out of the groove 20, 21, to be specific precisely when the carriage reaches its front end position, in which the section 20 of the groove coincides with the deflection path 17 of the driver dog. There is therefore no longer any force transmission between the driver dog 19 and the carriage 12. The carriage 12 remains at a standstill, while the driver dog 19 is passing through the deflection 17 in the groove section 20.

This is the state in which the operating cycle ends and begins. During the time period in which the carriage 12 is standing still, some tool operations may be carried out at the beginning of the operating cycle, in which a tape advance must not yet take place, namely, for example, the transfer of a tape 7 out of the magazine 3 into the tape guide channel 6.

The congruence of the groove 20, 21 with the deflection 17 of the driver dog 19 ends when the latter reaches the position 25 indicated by a chain-dotted line. It strikes against the transversely oriented flank of the groove section 21, which hence acts as a coupling stop. The carriage is then taken along to the right in the drawing by the driver dog. In the process, the flexible push rod 11 pushes the tape 7 forward. The carriage and advancing movement ends when the carriage reaches its rear end position, in which the driver dog moves from the lower to the upper run in the straight section 21 of the carriage groove. There, it strikes against the coupling stop formed by the lever 22 and then takes the carriage 12 back once more into its front initial position, the flexible push rod 11 likewise being pulled back into its initial position. During this, the free tape tongue can be threaded through the closure opening, gripped by the tensioning device, tensioned and cut off. The operating cycle ends as soon as the carriage has reached its front end position.

A coupling stop in the manner of the lever 22 may also be provided on the carriage in the region of the lower run 15. The stationary stop relating to its opening is then located at the rear end position of the carriage 12.

In the embodiment shown in FIG. 1, the carriage 12 stands still in its front end position only. When in its rear end position the driver dog 19 travels through the rectilinear groove section 21 from the lower run 15 up to the upper run 16, there is no congruency between this groove section 21 and the deflection 18. Therefore, the carriage 12 in its rear end position stands not still. In those cases in which it is desirable that the carriage stands still in its rear end position, the groove section 21 has to follow an arc which is congruent with the deflection 18. If it is to stand still in both end positions, the groove in the carriage 12 comprises two arcs, each arc corresponding to the deflections 17 or 18 respectively. These arcs can form together a complete circle. It may be advantageous to provide a lever 22 with a stationary stop 24 at the beginning of each of the arcs of the groove.

FIG. 2 shown a variant of the chain and carriage configuration. The chain, with the runs 15, 16, is guided in the deflection region over each of three wheels 30, 31, 32, which are indicated in the drawing at the left end. The same deflection geometry is also found at the right end. The groove 33 in the carriage 12 is therefore congruent at both ends with the deflection path of the driver dog, the latter passing through the groove 33 at the two ends, in each case in the opposite direction. The ends 34, 35 of the groove 33 run perpendicular to the direction of the runs 15, 16. Their flanks can therefore form the coupling stop for the driver dog. A coupling stop that moves away resiliently is not required. The standstill of the carriage in the end positions in each case begins when the driver dog has run around the first deflection wheel by 90°. Conversely, the advance or return in each case begins when the driver dog runs into the last quadrants at the last deflection wheel.

This is always the case when the deflection is not formed by a single deflection wheel, but comprises at least two deflection wheels, whose common tangent preferably extends perpendicular to the direction of the carriage guide. If only two such deflection wheels are present, the standstill path is formed by that section of the common tangent that is located between them. If this section is too short, it can be lengthened, for example in the form illustrated in FIG. 2, to form a "roundabout path".

I claim:

1. Tool for tying an article, such as a cable harness, by means of a tape (7), said tool comprises a tool body (1) having a carriage guide extending therealong, a carriage (12) that can move forwards and backwards thereon along said carriage guide (13, 14), and a closed pulling means (15, 16, 17, 18), which can be driven in only one direction, for driving the carriage, the pulling means having forward and backward runs (15, 16) parallel and adjacent to the carriage guide (13, 14), and having a driver dog (19), said carriage being provided with a coupling stop (22, 25, 34, 35) assigned to each run (15, 16) that cooperates with the driver dog (19).

2. Tool according to claim 1, characterized in that the tool includes deflection path means extending from one run to the other, the coupling stops (22, 34, 35) on the carriage (12) and assigned to the two runs (15, 16) being connected by a guide track (20, 21, 33) accommodating the driver dog (19) on its deflection path (17, 18) from one run (15, 16) to the other.

3. Tool according to claim 2, characterized in that the contour of at least one section (20, 33) of the guide track (20, 21, 33) coincides with the deflection path (17) of the driver dog (19) from one run (15, 16) to the other.

4. Tool according to claim 1, characterized in that at least one coupling stop (22) on the carriage (12) may be switched out and/or in by a stationary control cam (24).

5. Tool according to claim 4, characterized in that the coupling stop (22) includes means for urging the stop into the coupling position and permitting removal therefrom by exceeding a coupling force threshold, and in that the control cam (24) acts on the carriage or the coupling stop.

6. Tool according to claim 2, characterized in that at least one of the two deflection paths of the drive dog from one run (15, 16) to the other is longer than a circular arc.

* * * * *